United States Patent [19]

Fons

[11] Patent Number: 4,718,208

[45] Date of Patent: Jan. 12, 1988

[54] METHOD OF MAKING LARGE-VOLUME CONTAINERS, INDIVIDUAL SEGMENTS TO BE USED THEREFOR, AND ALIGNING TOOL FOR ALIGNING THE SAME

[75] Inventor: Gerrit Fons, Zaandam, Netherlands

[73] Assignee: Jansens & Dieperink BV, Zaandam, Netherlands

[21] Appl. No.: 935,943

[22] Filed: Nov. 28, 1986

[30] Foreign Application Priority Data

Dec. 3, 1985 [DE] Fed. Rep. of Germany ..... 3542709

[51] Int. Cl.[4] ..... E04H 7/00

[52] U.S. Cl. ..... 52/192; 220/5 A; 29/271

[58] Field of Search ..... 220/5 A, 75; 29/271, 29/272, 464, 428, 468, 281.5; 52/192, 82

[56] References Cited

U.S. PATENT DOCUMENTS

| | | | |
|---|---|---|---|
| 1,073,871 | 9/1913 | Sillman | 220/5 A |
| 1,127,226 | 2/1915 | Gamble | 220/5 A |
| 2,395,685 | 2/1946 | Schmitz | 220/5 A |
| 2,502,849 | 4/1950 | Jennings | 29/271 |
| 2,903,876 | 9/1959 | Nannini | 52/192 |
| 3,015,883 | 1/1962 | Brown | 29/271 |
| 3,292,324 | 12/1966 | Cole | 52/197 |
| 4,040,218 | 8/1977 | Stanelle | 52/194 |

FOREIGN PATENT DOCUMENTS

| | | |
|---|---|---|
| 1228391 | 11/1966 | Fed. Rep. of Germany . |
| 2159602 | 6/1973 | Fed. Rep. of Germany . |
| 50172 | 10/1966 | German Democratic Rep. . |
| 555940 | 2/1957 | Italy . |

*Primary Examiner*—James L. Ridgill, Jr.

*Attorney, Agent, or Firm*—Wallenstein, Wagner, Hattis, Strampel & Aubel, Ltd.

[57] ABSTRACT

The assembly of individual segments to obtain large-volume containers is facilitated by the edges of the individual segments being provided with projecting support members including cut-outs in which an aligning tool is insertable; an engaging element of said tool for aligning said one individual segment relative to the adjacent segment, which along the edge thereof is in contact with the edge of the first-mentioned individual segment, being brought into engagement with a surface of said adjacent individual segment so that the engaging element will ride or roll along the surface of said adjacent individual segment due to a pivoting or lever movement, the two edges being simultaneously brought to an aligned, coincident position.

9 Claims, 8 Drawing Figures

METHOD OF MAKING LARGE-VOLUME CONTAINERS, INDIVIDUAL SEGMENTS TO BE USED THEREFOR, AND ALIGNING TOOL FOR ALIGNING THE SAME

The invention is directed to a method of making large-volume containers such as silos, mixing containers, storage bins, tanks and the like from prefabricated individual segments, and to such an individual segment and to an aligning tool for aligning adjacent individual segments during assembly thereof.

Large-volume containers have been increasingly used over many years, for instance to make cement available at a construction site, to store raw materials or intermediates for the preparation of plastic materials, or to keep large volumes of liquids in stock. Such large-volume containers have considerable dimensions such as a height of from 10 to 40 m and a diameter of several meters. In this connection there arises the problem of having such projecting large-volume containers transported quickly and economically from the manufacturing site to the site of use.

One way of solving said problem resides in that, in accordance with the DE-OS No. 2,159,602, the large-volume containers are configured with slightly conical main parts adapted to be nested within each other during transport, so that a large number of such nested container main parts can be transported with a minimum requirement of transport space.

Another way of solving said problem resides in that individual segments for the large-volume container are prefabricated at the manufacturing site, transported to the place of use and only then assembled to complete the large-volume container. In this connection it is known (US-PS No. 3,292,324) to assemble square cross-section containers at the site of use by having longitudinally extending steel angles provided inside the containers with flat plates bolted thereto, while the edges of said plates which extend transversely to the container axis are provided with steel angles or are themselves bent outwardly so that a plurality of such individual segments may respectively be assembled with each other. Starting from this principle, it is also known (US-PS 4,040,218, FR-PS No. 1,000,784 and IT-PS No. 555,940) to assemble silos of approximately cylindrical cross-section by joining and mutually bolting annular cylinder portions with end flanges being provided therebetween. In this connection it is also known to divide such annular container parts themselves into individual ring segments and to assemble these segments by joining them in overlapping or abutting relationship to constitute the annular members. Such individual segments comprise a wall portion corresponding to a wall area of the container and at least one support member projecting from the edge of said wall portion, said support member in addition to reinforcing the wall portion being also used to connect adjacent individual segments by means of a connecting element, for instance by means of bolts.

It has been found, however, that the assembly of such individual segments at the construction site causes serious problems because the individual segments themselves are relatively heavy. But aligning of the individual segments relative to each other causes still greater difficulties when some individual segments have already been assembled and are to be connected to a number of other individual segments. Since the individual segments are prefabricated, it is important that on assembly they are given the intended position relative to or against each other before they are connected to one another, all the more as the sealing of the large-volume container in respect of the outside depends largely on such alignment.

It is therefore the object of the invention to simplify assembly of the individual segments to form the large-volume container or at least parts thereof, whereby assembly time and assembly costs can be reduced.

The invention resides in that the individual segments are joined to each other with such support members that are formed with at least one cut-out accessible from outside, especially on that side of the support member remote from the adjacent individual segment to which it is to be joined. Thereafter, an aligning tool is inserted with a retaining element thereof into the cut-out of said one individual segment, especially hooked and latched therein, and is placed with an engaging element against the adjacently joined individual segment. Finally, the aligning tool is pivoted while riding or rolling along a surface of the adjacent individual segment to thereby align the same relative to the other individual segment until alignment of the joined individual segments has been achieved.

To perform this method it is recommended to use an aligning tool in accordance with a further embodiment of the invention, said tool comprising a retaining element for insertion in a cut-out of a support member of said one individual segment and an engaging element for engagement on the surface of an adjacent individual segment in such an arrangement, wherein at least the engaging element is pivotable relative to the cut-out to thereby move said one individual segment relative to the other one into the aligned position mainly by the use of leverage.

In this connection it is advantageous when the individual segment according to a further embodiment of the invention comprises at least one support member projecting from the edge thereof and said support member is formed with a cut-out which is accessible from the side remote from said edge and which especially extends along the entire edge of the support member. In this connection it is advantageous when the support member is an extruded section bar which is welded to the wall portion which is especially made from thinner-walled sheet metal.

Provided the invention is used with substantially cylindrical or slightly conical large-volume containers while it is not limited thereto, because it is also possible to make rectangular large-volume containers in accordance with the invention, it is advantageous when the extruded section-bar support member is curved and then welded to the sheet metal so that the individual segments prefabricated therefrom are parts of an annulus or ring segment which are provided with the support members on the end faces of the ring. Moreover, it is advantageous also to provide the other edges extending between the end faces of these ring segments with such support members so that also the individual segments of a ring itself can be aligned with and connected to one another correspondingly. The connection can be made by bolting, welding and/or by means of clamping devices.

Further embodiments of the invention are specified in subclaims and will be explained in the following description by way of examples with reference to the accompaning drawing, in which:

Figure 1:
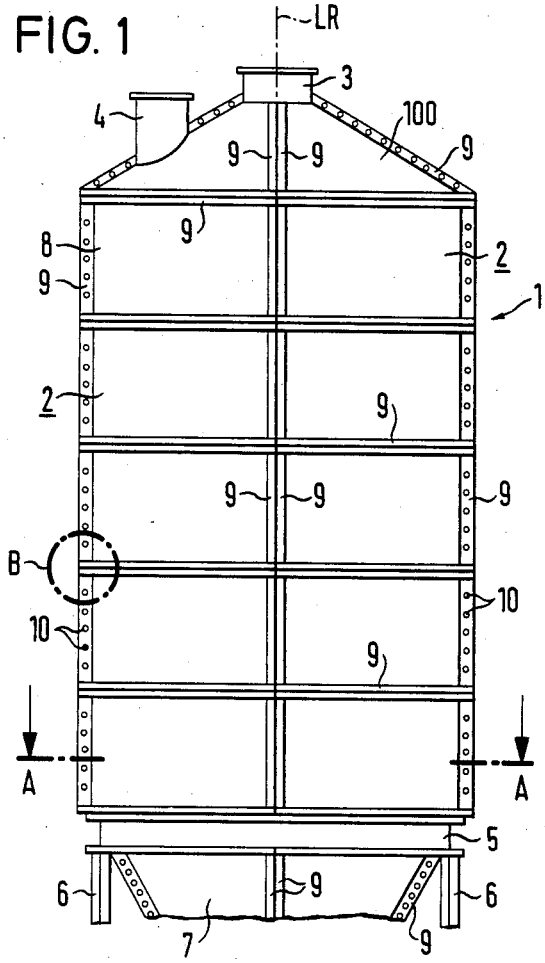
FIG. 1 is a schematic external view showing a portion of an upright silo-like container.
Figure 2:
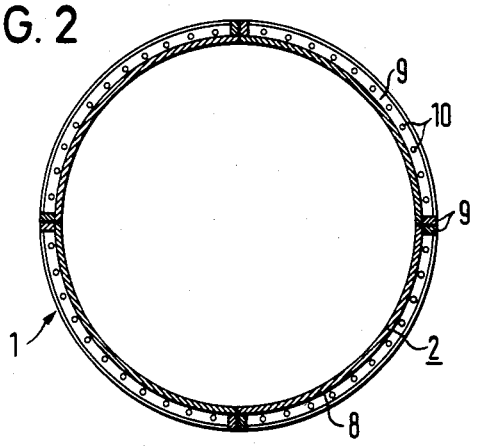
FIG. 2 is a partial sectional top view A—A of FIG. 1.

As shown in FIG. 1, the silo 1 serving as the container is composed of a number of individual segments 2 which form tier-like rings, each ring being set up of four individual segments 2 as shown in FIG. 2. The cylindrical main portion of the silo 1, which is made up of five such ring tiers, has a cover unit placed thereon which is provided with a filling port 3 and a further filling and/or venting tube 4 through which material may be filled. The silo main portion is mounted on a support ring 5 composed of U-sections and being in turn supported on legs 6. Moreover, the silo main portion is welded to a downwardly tapering discharge hopper 7.

The individual segments 2 each consist of a wall portion 8, for instance relatively thin-walled aluminium plate, and of support members 9 which are in the form of outwardly projecting flanges and are provided with openings 10 through which bolts may be inserted to serve as connecting elements 12 so that individual segments 2 can be firmly secured to each other after having been mutually aligned.

As shown in FIGS. 1 and 2, the wall portions 8 of the individual segments 2 include straight support members 9 which extend in longitudinal direction LR of the silo 1 and support members 9 extending transversely thereto about the cylindrical periphery of the silo 1.

Figure 3:
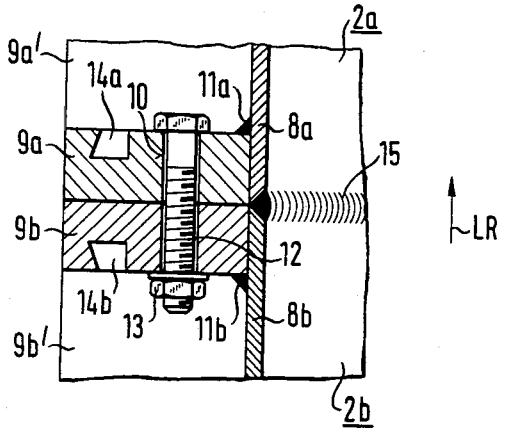
FIG. 3 is an enlarged fragmentary view from the portion B of FIG. 1.

This will become more apparent from FIG. 3: in this embodiment two individual segments, viz. the upper individual segment 2*a* and the lower individual segment 2*b*, have already been joined to each other in the aligned position. The wall portion 8*a* of the upper individual segment 2*a* is welded to the annular support member 9*a* along the weld bead 11*a*, and the likewise radially outwardly projecting support member 9*b* of the lower individual segment 2*b* is welded to the wall portion 8*b* thereof along the annular weld bead 11*b*. Similarly, the support members 9*a*' and 9*b*' extending in longitudinal direction LR are also welded along the wall portions 8*a*, 8*b* on the outside thereof. A connecting bolt 12 has been inserted through the openings 10 in the support members 9*a*, 9*b*. After tightening of the nut 13, the two individual segments 2*a* and 2*b* are firmly bolted to each other in stacked relationship. As will be explained below, the cut-outs 14*a* and 14*b* have the function of aligning the two individual segments 2*a*, 2*b* relative to one another. Following the joining operation, the two wall portions 8*a*, 8*b* may be welded in the aligned position along the joint, to which end a weld bead 15 may be applied along the inside.

Figure 4:
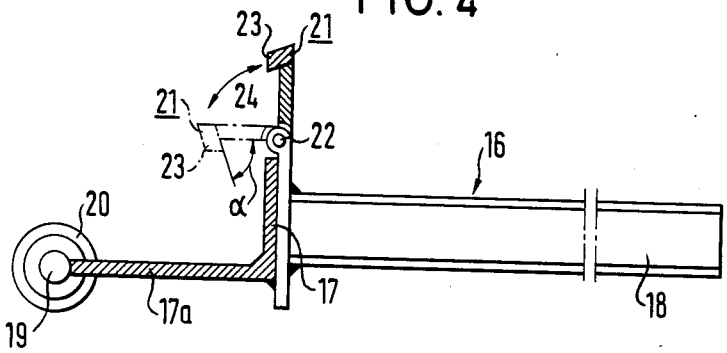
FIGS. 4 and 5 are schematic views of an aligning tool from two viewing directions relatively rotated about 90°.
Figure 5:
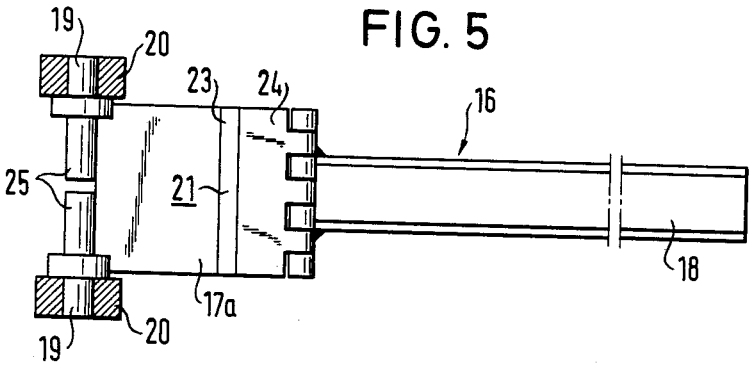

According to FIGS. 4 and 5, the aligning tool 16 shown schematically therein comprises a bracket 17 which is firmly joined to a handle 18 by means of welding. The end of the arm 17*a* of the bracket 17 is provided with a bearing 19 for accommodating two rollers serving as engaging elements 20. A retaining member 21 is hook-shaped, the hook being pivotable relative to the bracket 17 about the axis 22 in the direction of the arrow. Advantageously, the angle $\alpha$ between the bent hook portion 23 and the arm 24 extending towards the pivot 22 is selected to be approximately between 60 and 80°. The diameter of the shafts 25 of the bearing 19 is 16 mm in the instant example, whereas the outer diameter of the engaging element 20, which is a roller, is between approximately 30 and 50 mm.

Figure 6:
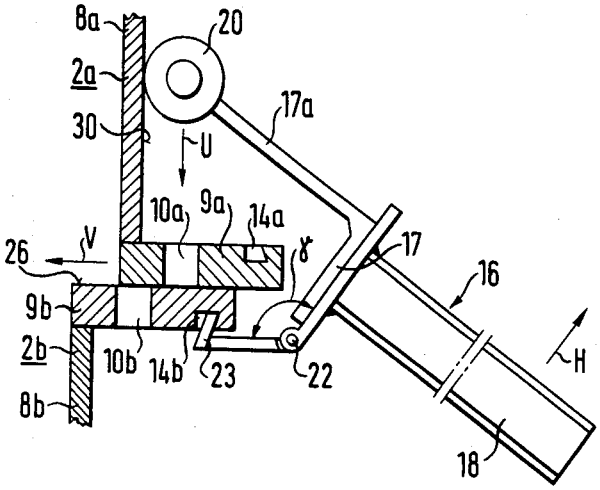
FIGS. 6 and 7 are views of two different positions of two adjacent individual segments in the non-aligned position as shown in FIG. 6 and, as shown in FIG. 7, in the aligned position achieved by using the aligning tool and prior to joining the adjacent individual segments.
Figure 7:
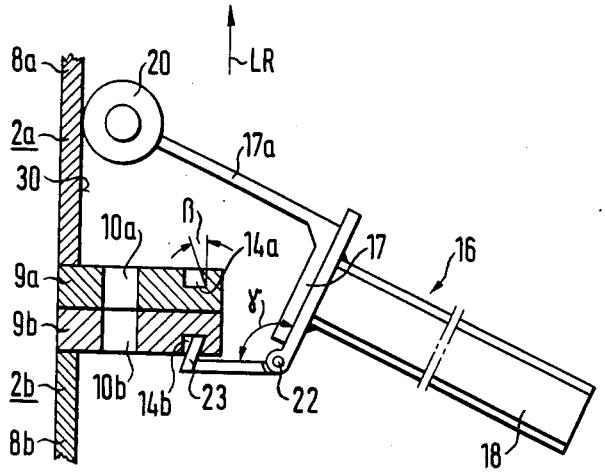

FIG. 6 shows schematically the stacked position of the two adjacent individual segments 2*a* and 2*b*, which are not yet aligned relative to each other. What must be done is to push or pull the upper individual segment 2*a* forward along the arrow V until the two openings 10*a* and 10*b* are in alignment with each other. To this end the bent hook portion of the retaining member 23 is inserted into the downwardly open cut-out 14*b*. Since in the instant embodiment the cut-out 14*b* is likewise inclined at the angle $\beta 0$ shown in FIG. 7 between about 60° and 80° relative to the longitudinal or vertical direction, it is ensured that, when the engaging element 20 is in contact with the outer surface 30 of the wall portion 8*a* of the upper individual segment 2*a* and rides downwards along the arrow U, the retaining element 23 will not slip from the cut-out 14*b*. Instead, the retaining element 23 with its arm 24 extending towards the pivot 22 will remain in the position of FIG. 6, while the angle $\gamma$ between the arm 24 of the retaining element 23 and the bracket 17 will be decreased by pulling or pivoting the handle 18 up along the arrow H. Due to this reduction of the angle the roller-like retaining element 20 will ride along the outer surface 30 of the upper individual segment 2*a* by rolling in the direction of the arrow U, while at the same time said upper individual segment 2*a* will be pushed forward along the arrow V until the two openings 10*a* and 10*b* are in alignment as shown in FIG. 7. In this the connecting element 12 may be inserted through the openings 10*a* and 10*b* and both individual segments 2*a* and 2*b* may be connected to each other and, if desired, welded along the joint, whereupon the aligning tool 16 is removed. It is important that during the aligning operation the retaining element 23 does not slip out of the cut-out 14*b* in the support member 9*b*. It is therefore important that said cut-out 14*b* should open downwardly in this position, i.e. in opposition to the end face 26 of the lower individual segment 2*b*, i.e., in a direction remote from the adjacent individual segment 2*a*.

Figure 8:
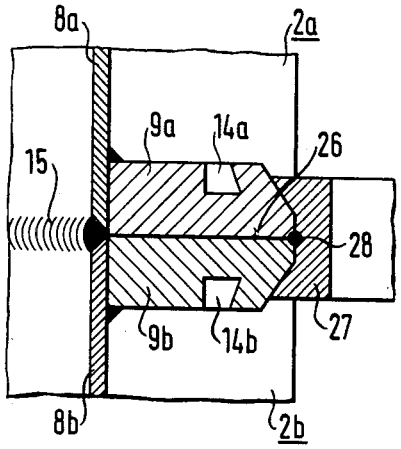
FIG. 8 is a fragmentary view approximately corresponding to FIG. 3 and showing another embodiment of the invention.

FIG. 8 illustrates another alternative in the already joined condition of the two individual segments 2*a* and 2*b*. Here, the support members 9*a*, 9*b*, which likewise project flange-like at an angle of 90° to the longitudinal extension of the wall portions 8*a*, 8*b*, are also disposed with the cut-outs 14*a* and 14*b* provided on sides remote from each other. In place of connecting bolts 12 the two support members 9*a* and 9*b* are held together by a tension ring 27. If desired, the tension ring 27 may be removed after application of the weld bead 15, and a further weld bead 28 may be applied externally along the joint of the two outer edges 26 of the two individual segments 2*a* and 2*b*.

Whereas the wall portions 8*a* are preferably made from aluminium plate, extruded section material of aluminium is used for the support members 9*a*, 9*b*, the wall thickness of said material being considerably greater than that of the wall portions 8*a*, 8*b*.

In place of the outer weld bead 28 it is also possible to provide a sealing ring between the tension ring 27 and the two support members *9a, 9b.*

The use of extruded section material for the curved support members 9 with the channel-like cut-out 14 extending along the length thereof offers the additional advantage that the aligning tool 16 may be moved along said channel-like cut-out 14 so as to cause intermittent aligning movements of the one individual element 2 relative to the adjacent individual element 2. Of course, it is also possible to insert plural aligning tools in one and the same channel-like cut-out 14 so that, especially in case of larger and heavier individual segments or in case of container parts already assembled from individual segments, several operators will simultaneously actuate such aligning tools and provide for alignment. Of course, aligning tools may also be operated mechanically instead of manually.

In addition to constituting the substantially cylindrical container surface or main part, the wall portions 8 together with the support members 9 may also be adapted for assembly of the discharge hopper 7 and the container roof 100 in the form of individual segments 2 with correspondingly modified shape.

However, the invention is by no means limited to terrestrial applications but may also be used, for instance, for underwater-assembly of container or support members, e.g. structural parts of drilling platforms, or for extra-terrestrial applications such as the assembly of space stations.

I claim:

1. A method of making large volume containers such as silos, storage bins, tanks, and the like, comprising: providing prefabricated individual segments each constituting a portion of the container wall and each having an outwardly projecting support member joined thereto along an edge thereof by means of which the individual segments forming one portion of the container wall are interconnected to the individual segments forming another portion of the container wall, said support members being characterized in that they are provided with at least one cut-out which extends only partly into the support member adjacent to the outer margin thereof; positioning the segments forming one portion of the container wall on the segments forming another portion of the container wall so that the outwardly projecting support members thereof are in contact with one another; engaging an aligning tool on one of the support members while it is in contact with the other support member, said aligning tool having a retaining element adapted to be inserted in the cut-out of said one support member, and being provided with at least one roller member which is adapted to be positioned against the outer surface of the segment to which said other support member is joined; moving the roller member of said tool along the outer surface of said segment while the retaining element is positioned in the cut-out of said one support member until the support members of each segment are in aligned relation to one another; and interconnecting the thusly aligned support members.

2. A method as claimed in claim 1, wherein said cut-out is in the form of a channel which extends along the length of the support member to enable the retaining element of the aligning tool to be moved therealong while aligning the support members of each segment.

3. An aligning tool for aligning individual wall-forming segments having outwardly extending flange-like support members joined along an edge thereof, said members being provided with at least one cut-out adjacent to the outer margin thereof and being adapted when aligned to be connected to form a large volume container in accordance with the method of claim 1, comprising: a retaining element adapted to be inserted into the cut-out of a support member of an individual segment; and an engaging element adapted to be placed against the outer surface of an adjacent individual segment to be aligned with the individual segment in which said retaining element is inserted, said engaging element having at least one roller element for rolling movement along the outer surface of said adjacent individual segment whereby the flange-like support members of the individual segments are urged into aligned relation to one another.

4. An aligning tool as claimed in claim 3 wherein said retaining element is configured as a hook.

5. An aligning tool as claimed in claim 3 wherein the retaining element is pivotally mounted on a bracket having said at least one roller element secured thereto.

6. An aligning tool as claimed in claim 5 wherein a handle is in engagement with said bracket.

7. An individual segment for use in the manufacture of large-volume containers such as silos, storage bins, tanks, and the like, said segment comprising a wall portion corresponding to a wall area of the container and having at least one flange-like support member projecting from an edge thereof for connection to another individual segment having a similar support member by use of connecting means, said support member being formed with a channel-like cut-out which margin of said flange-like support member.

8. An individual segment as claimed in claim 7, wherein an extruded section bar is used as said flange-like support member.

9. An individual segment as claimed in claim 8, wherein said extruded section bar comprising the flange-like support member is curved and is secured along a margin of the wall portion of said segment as by welding.

* * * * *